US005579819A

United States Patent [19]

Hung et al.

[11] Patent Number: 5,579,819

[45] Date of Patent: Dec. 3, 1996

[54] PULLING KNOB ASSEMBLY FOR VENETIAN BLIND

[76] Inventors: Wen-Chung Hung, No. 100, HWA Shan Load; Suy-Po Chang, No. 154, Guang HWA Load, both of Changhwa City, Taiwan

[21] Appl. No.: 305,094

[22] Filed: Sep. 13, 1994

[51] Int. Cl.[6] ..... E06B 9/38

[52] U.S. Cl. ..... 160/178.1; 16/122; 24/578; 24/602

[58] Field of Search ..... 24/578, 662, 602, 24/128, 115 F, 129 D, 130, 129 R, 116 A, 116 H; 16/114 B, 122, 127, 216, 217, 218; 160/178.1 R, 178.1 V, 173 R

[56] References Cited

U.S. PATENT DOCUMENTS 2,164,206 6/1939 Gits et al. ..... 16/122

2,955,379 10/1960 Hull ..... 16/122 X

FOREIGN PATENT DOCUMENTS 503461 6/1920 France ..... 24/578

8403506 12/1985 Netherlands ..... 160/178.1

*Primary Examiner*—Blair Johnson

*Attorney, Agent, or Firm*—Bacon & Thomas

[57] ABSTRACT

A pulling knob for coupling the pulling cords of venetian blind together includes a ring shaped body secured to one of the cords and having two annular flanges oppositely extended from the side portions. A number of caps each includes an annular shoulder for engaging with the annular flange so as to be attached to the ring shaped body. The caps each includes a notch for engaging with the other cords so as to couple the cords together. The caps can be easily disengaged from the body in order to release the cords.

1 Claim, 3 Drawing Sheets

PULLING KNOB ASSEMBLY FOR VENETIAN BLIND

BACKGROUND OF THE INVENTION (a) Field of the Invention

The present invention relates to a pulling knob, and more particularly to a pulling knob assembly for venetian blind mechanisms.

(b) Description of the Prior Art

Typical pulling knob devices for venetian blind includes a knob 2 secured to the bottom ends of two or more pulling cords S, as shown in FIG. 1, for operating the venetian blind. As shown in FIGS. 1A and 1B, the knob 2 includes an opening 22 for threading the pulling cords S which includes knots S1 engaged in the interior 21 of the knob 2, such that the cords S are enclosed or secured together at the bottom end portions R which can not be easily separated from each other. As best shown in FIG. 1B, when an object H is engaged in the enclosed portion R of the cords S, the cords S may be entangled at S2. If the object H is the children's necks, the children will be killed by the cords inadvertently.

The present invention has arisen to mitigate and/or obviate the afore-described disadvantages of the conventional venetian blind mechanisms.

SUMMARY OF THE INVENTION

The primary objective of the present invention is to provide a pulling knob assembly for venetian blind in which the coupling portions of the cords may be easily disengaged from each other.

In accordance with one aspect of the present invention, there is provided a pulling knob assembly for attaching to pulling cords of venetian blind, the pulling knob assembly comprising a body for securing to a first of the cords and including at least one annular flange extended therefrom, and at least one cap including an annular shoulder formed therein for engaging with the annular flange of the body so as to be attached to the body, the cap including a side portion having a notch formed therein for engaging with a second of the cords so as to couple the first and second cords together, the cap being disengaged from the body in order to release the second cord.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
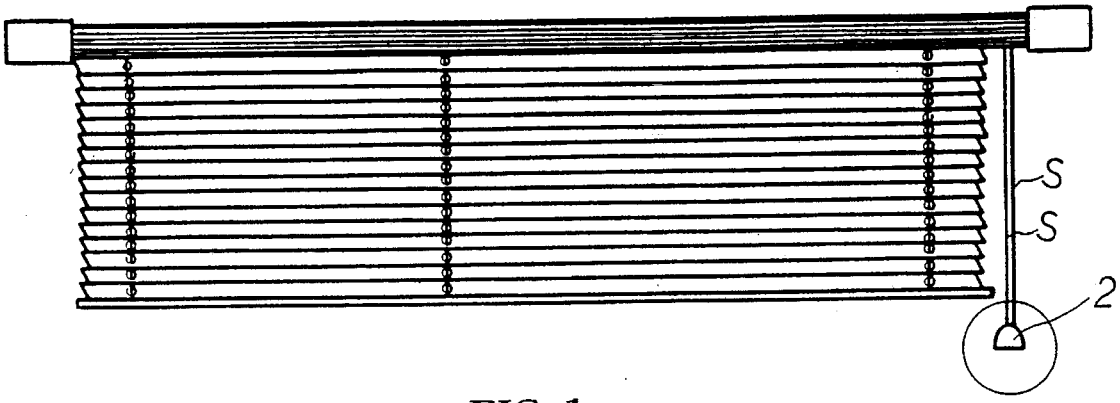
FIG 1 PRIOR ART
FIG. 1 is a plane view showing a typical venetian blind configuration.
Figure 1A:
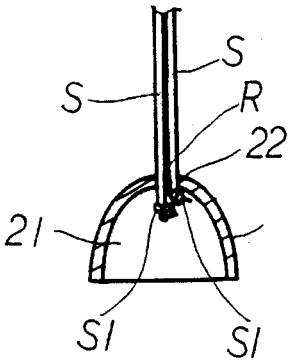
FIG 1A PRIOR ART
FIG. 1A and 1B are cross sectional views of the pulling knobs.
Figure 1B:
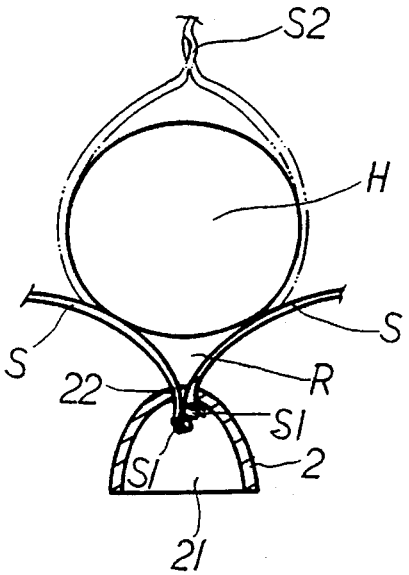
FIG 1B PRIOR ART
Figure 2:
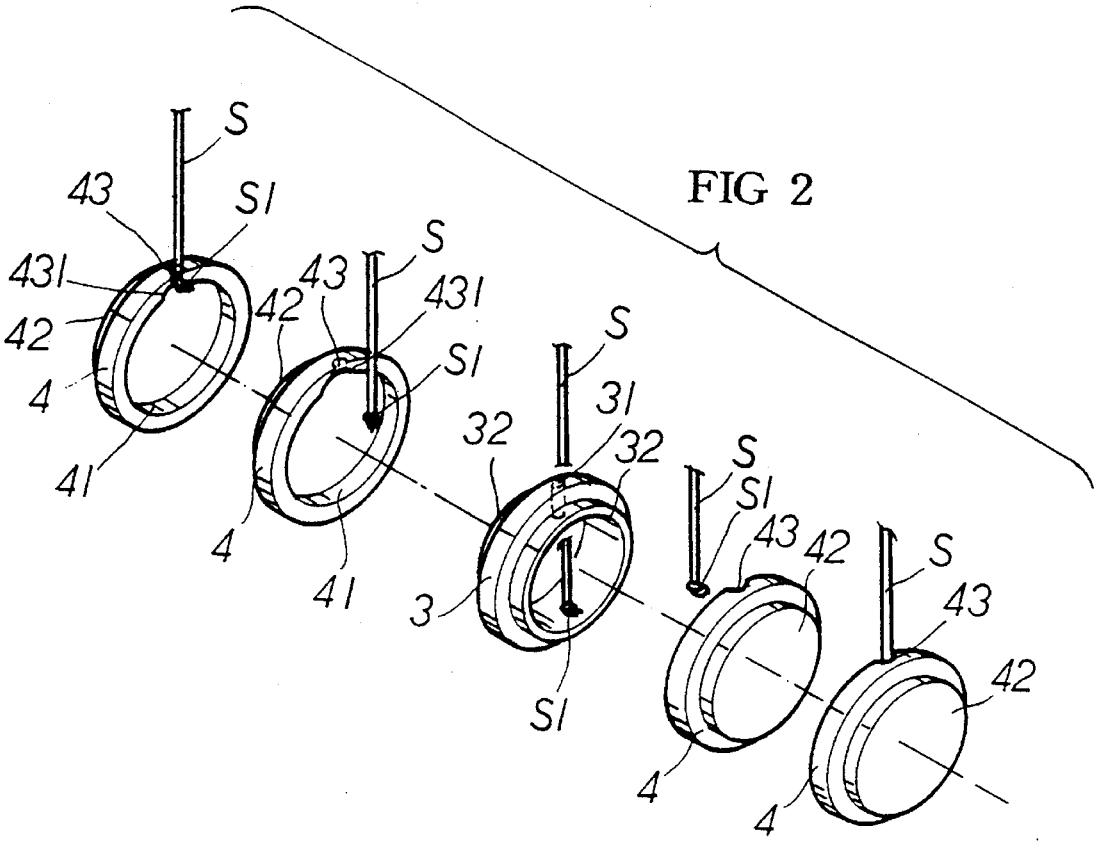
FIG. 2 is an exploded view of a pulling knob assembly in accordance with the present invention.
Figure 2A:
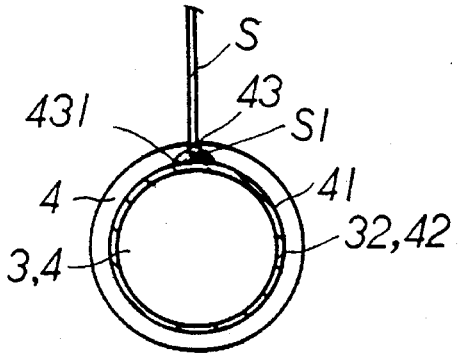
FIG. 2A is a cross sectional view taken along lines 2A—2A of FIG. 3B.

Referring to the drawings and initially to FIGS. 2 and 2A, a pulling knob assembly in accordance with the present invention comprises a ring-shaped body 3 including a hole 31 formed therein for threading cord S which includes a knot S1 formed in the bottom end and located within the body 3. The body 3 includes two annular flanges 32 oppositely extended outward from the side portions thereof. A number of caps 4 each includes an annular shoulder 41 formed therein for engaging with the annular flanges 32 of the body 3 and each includes a reduced diameter disc member 42 formed on one side of the cap 4 and having a diameter equals to that of the annular flange 32 so as to engage with the annular shoulders 41 of other caps 4. Each of the caps 4 includes another side, opposite to the disc member 42, having a notch 43 formed therein for threading the cord S and having a depression 431 formed therein for receiving the knot S1 of the cords S.

Figure 3A:
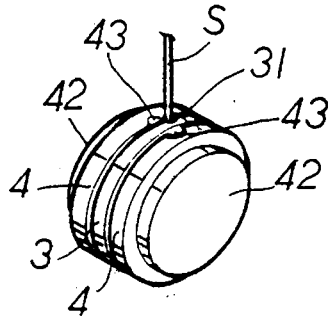
FIGS. 3A, 3B, 3C, 3D, 3E are perspective views illustrating five applications of the present invention.
Figure 3B:
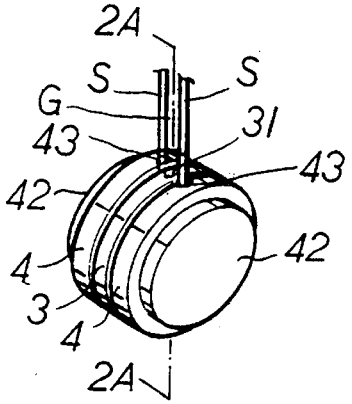
Figure 3C:
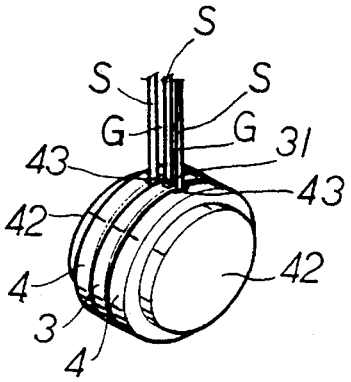
Figure 3D:
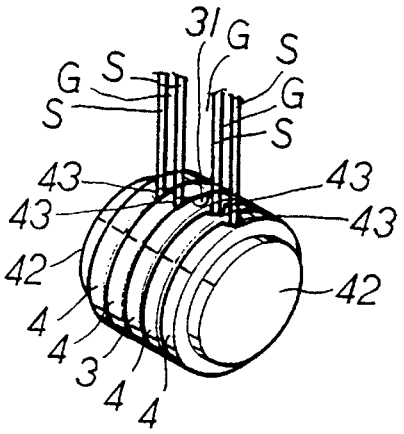
Figure 3E:
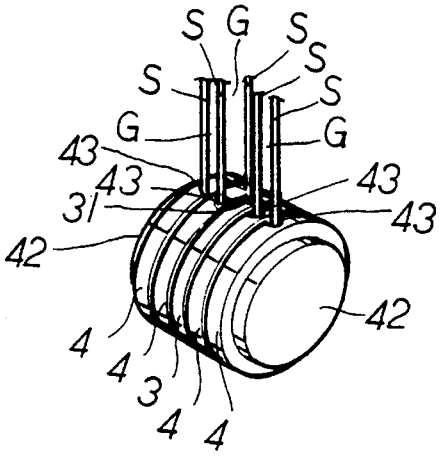
Figure 4:
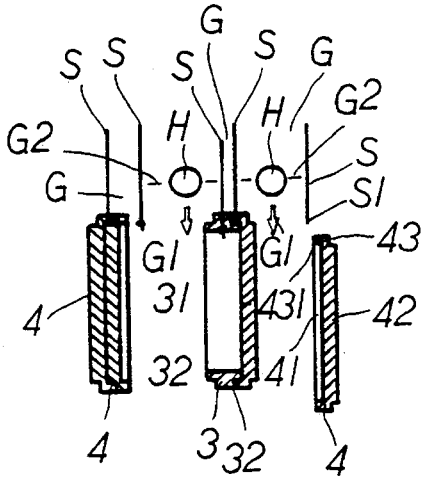
FIG. 4 is an exploded and cross sectional view illustrating the operation of the present invention.

Referring next to FIG. 3A, only one cord S is engaged with the body 3. As shown in FIGS. 3B to 3E, two or more caps 4 are engaged with the body 3 so as to couple the end portions of the cords S together such that one or more coupling portions G may be formed. As shown in FIG. 4, when an object H is engaged in the coupling portion G and when the object H moves toward the body 3 and cap 4 in the direction as shown by arrow G1, the object H may apply a side force G2 against the body 3 and the cap 4 such that the cap 4 and the body 3 may be separated from each other and such that the object H will not be entangled by the cords S. The body and the cap may be easily secured to the cords S again by simply engaging the caps to the body.

Accordingly, the pulling knob assembly in accordance with the present invention may be easily secured to the pulling cords and may be easily disengaged for releasing the cords.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pulling knob assembly for attaching to a plurality of pulling cords of a venetian blind assembly, said pulling knob assembly comprising:

a body secured to an end of a first of said pulling cords said body having opposite side portions with an annular flange extending from each opposite side portion; and at least one cap having an annular shoulder releasably engaged with one of said annular flanges of said body so as to be removably attached to said body, said at least one cap including a side portion having a notch formed therein engaged with a second of said plurality of pulling cords so as to couple said first and second pulling cords together, said cap being completely disengagable from said body in order to uncouple the first and second pulling cords.

* * * * *